US011187475B2

(12) United States Patent
Romano

(10) Patent No.: US 11,187,475 B2
(45) Date of Patent: Nov. 30, 2021

(54) NON-SEMIAUTOMATIC RECEIVER COMPATIBLE WITH AR15/10 LINE OF COMPONENTS, PARTS AND ACCESSORIES

(71) Applicant: Vincent William Romano, Skokie, IL (US)

(72) Inventor: Vincent William Romano, Skokie, IL (US)

( * ) Notice: Subject to any disclaimer, the term of this patent is extended or adjusted under 35 U.S.C. 154(b) by 0 days.

(21) Appl. No.: 16/825,447

(22) Filed: Mar. 20, 2020

(65) Prior Publication Data

US 2020/0300565 A1 Sep. 24, 2020

Related U.S. Application Data

(60) Provisional application No. 62/822,523, filed on Mar. 22, 2019.

(51) Int. Cl.
*F41A 3/68* (2006.01)
*F41A 3/66* (2006.01)

(52) U.S. Cl.
CPC . *F41A 3/68* (2013.01); *F41A 3/66* (2013.01)

(58) Field of Classification Search
CPC ..... F41A 3/38; F41A 3/42; F41A 3/66; F41A 3/68; F41A 17/42
USPC ..... 89/128, 138; 42/16
See application file for complete search history.

(56) References Cited

U.S. PATENT DOCUMENTS 5,519,954 A * 5/1996 Garrett ..... F41A 17/38 42/6
6,212,814 B1 * 4/2001 Lambie ..... F41A 11/02 42/75.03
7,661,219 B1 * 2/2010 Knight, Jr. ..... F41A 35/06 42/70.02
2005/0011345 A1 * 1/2005 Herring ..... F41A 5/26 89/1.4
2017/0045318 A1 2/2017 Verney-Carron
2017/0160026 A1 * 6/2017 Walther ..... F41A 3/68
2018/0100714 A1 * 4/2018 Borders ..... F41A 17/42
2019/0041153 A1 2/2019 Fellows et al.
2019/0041175 A1 2/2019 Fellows et al.
2019/0072349 A1 3/2019 Verney-Carron
2019/0093971 A1 3/2019 Verney-Carron
2019/0137202 A1 * 5/2019 Facchini ..... F41A 17/36
(Continued)

OTHER PUBLICATIONS

Stephen Gibbs for Daily Mail Australia, How a Deadly Rifle Can File Six Shots in Three Seconds is Exploiting Australia's Tough Gun Laws, Daily Mail Online, https://www.dailymail.co.uk/news/article-7370191/How-deadly-rifle-fire-six-shots-three-seconds-exploiting-Australias-tough-gun-laws.html, Aug. 19, 2019 (11 pages).
(Continued)

*Primary Examiner* — Bret Hayes
(74) *Attorney, Agent, or Firm* — McCracken & Gillen LLC

(57) ABSTRACT

A receiver for a firearm and a method of disposing the receiver to prevent automatic reloading and/or trigger reset of a firearm are disclosed. A blocking mechanism is moveable between an upward and a downward position and the blocking mechanism is in the downward position when the firearm is in battery. The blocking mechanism automatically moves to the upward position after a round is fired and the blocking mechanism prevents automatic reloading and/or trigger reset of the firearm when in the upward position.

18 Claims, 5 Drawing Sheets

(56) References Cited

U.S. PATENT DOCUMENTS

2019/0234720 A1 8/2019 Fellows et al.

OTHER PUBLICATIONS

Dan Zimmerman, Verney-Carron's Speedline Rifle is a 'Semi-Semi-Automatic' and Australians are Freaking Out!—The Truth About Guns; https://www.thetruthaboutguns.com/verney-carrons-speedline-rifle-is-a-non-semi-automatic-and-australians-are-freaking-out/; Aug. 20, 2019 (4 pages).

* cited by examiner

NON-SEMIAUTOMATIC RECEIVER COMPATIBLE WITH AR15/10 LINE OF COMPONENTS, PARTS AND ACCESSORIES

CROSS-REFERENCE TO RELATED APPLICATIONS

This patent application claims benefit of U.S. Provisional Patent Application Ser. No. 62/822,523, filed on Mar. 22, 2019, entitled "Non-Semiautomatic Receiver Compatible with AR15/10 Line of Components, Parts and Accessories." The entire contents of this application is incorporated herein by reference.

BACKGROUND

Currently, firearm receivers for an AR15/10, M16 fully automatic, and similar firearms are semiautomatic. Regulations of the Bureau of Alcohol Tobacco and Firearms (ATF) specify as semiautomatic pistol as any repeating pistol which utilizes a portion of the energy of a firing cartridge to extract the fired cartridge case and chamber the next round, and which requires a separate pull of the trigger to fire each cartridge; and a semiautomatic rifle as any repeating rifle which utilizes a portion of the energy of a firing cartridge to extract the fired cartridge case and chamber the next round, and which requires a separate pull of the trigger to fire each cartridge. (See for example, ATF Regulations, 27 CFR Part 478, Subpart B, § 478.11).

Further, the Wikipedia entry for a Firearm states: "A semi-automatic firearm, also called self-loading firearm or autoloading firearm (though fully automatic and selective fire firearms technically are also self-loading), is one that not only fires a bullet each time the trigger is pulled, but also performs all steps necessary to prepare it to discharge again—assuming cartridges remain in the firearm's feed device. Typically, this includes extracting and ejecting the spent cartridge case from the firing chamber, re-cocking the firing mechanism, and loading a new cartridge into the firing chamber. To fire again, the trigger is released and re-pressed."

Semiautomatic rifles are banned in some jurisdictions or in certain environments. Yet, the AR15 is considered by many to be one of the most popular and versatile platforms in the world. If a person lives in or travels to one of these destinations where semiautomatic rifles are banned, such person may not be able possess or bring with them their semiautomatic AR15 rifle/pistol/equipment, or similar firearm.

The embodiments of the receiver described herein address a problem that may arise in environments where a semiautomatic firearm, for example, the AR15/10 platform, is banned because such platform is semiautomatic. The receiver may also allow the use of various available AR15/10 (or other firearm) parts, components, and accessories available on the market. In addition, such receiver allows the use of AR15/10 hunting or self-defense rifle or pistol components in a non-semiautomatic configuration, and thus may permit the use of such rifle or pistol in combination with widely available barrel, optics, handguards, stock, and the like. Further, the receiver may be used with other components of such rifle/pistol that has been sighted in for accuracy, for example. The embodiments of receivers described herein may be used in place of a semiautomatic receiver with components typically used with an AR15/10 (or other) firearm to configure a non-semiautomatic firearm.

SUMMARY

According to one aspect, a receiver for a non-semiautomatic firearm includes a blocking mechanism moveable between an upward and a downward position. The blocking mechanism is in the downward position when the firearm is in battery and automatically moves to the upward position after a round is fired. The blocking mechanism prevents automatic reloading of the non-semiautomatic firearm and/or resetting a trigger of the firearm when in the upward position.

According to another aspect, a method of preventing automatic reloading of a non-semiautomatic firearm and/or resetting a trigger of the firearm includes disposing a blocking mechanism moveable between an upward and a downward position in a receiver of the firearm and holding the blocking mechanism in the downward position when the firearm is in battery. The method further includes automatically moving the blocking mechanism to the upward position after a round is fired, wherein the blocking mechanism prevents automatic reloading and/or resetting of a trigger of the firearm of the non-semiautomatic firearm when in the upward position.

Other aspects and advantages will become apparent upon consideration of the following detailed description and the attached drawings wherein like numerals designate like structures throughout the specification.

DESCRIPTION OF THE DRAWINGS

Features of example implementations of the invention will become apparent from the description, the claims, and the accompanying drawings in which:

For the sake of clarity, identical components which have identical functions have been designated by identical characters throughout the several views illustrated in the drawings.

DETAILED DESCRIPTION

The attached figures and description below illustrate one possible configuration of a device that comprises a non-semiautomatic firearm receiver.

Figure 1:
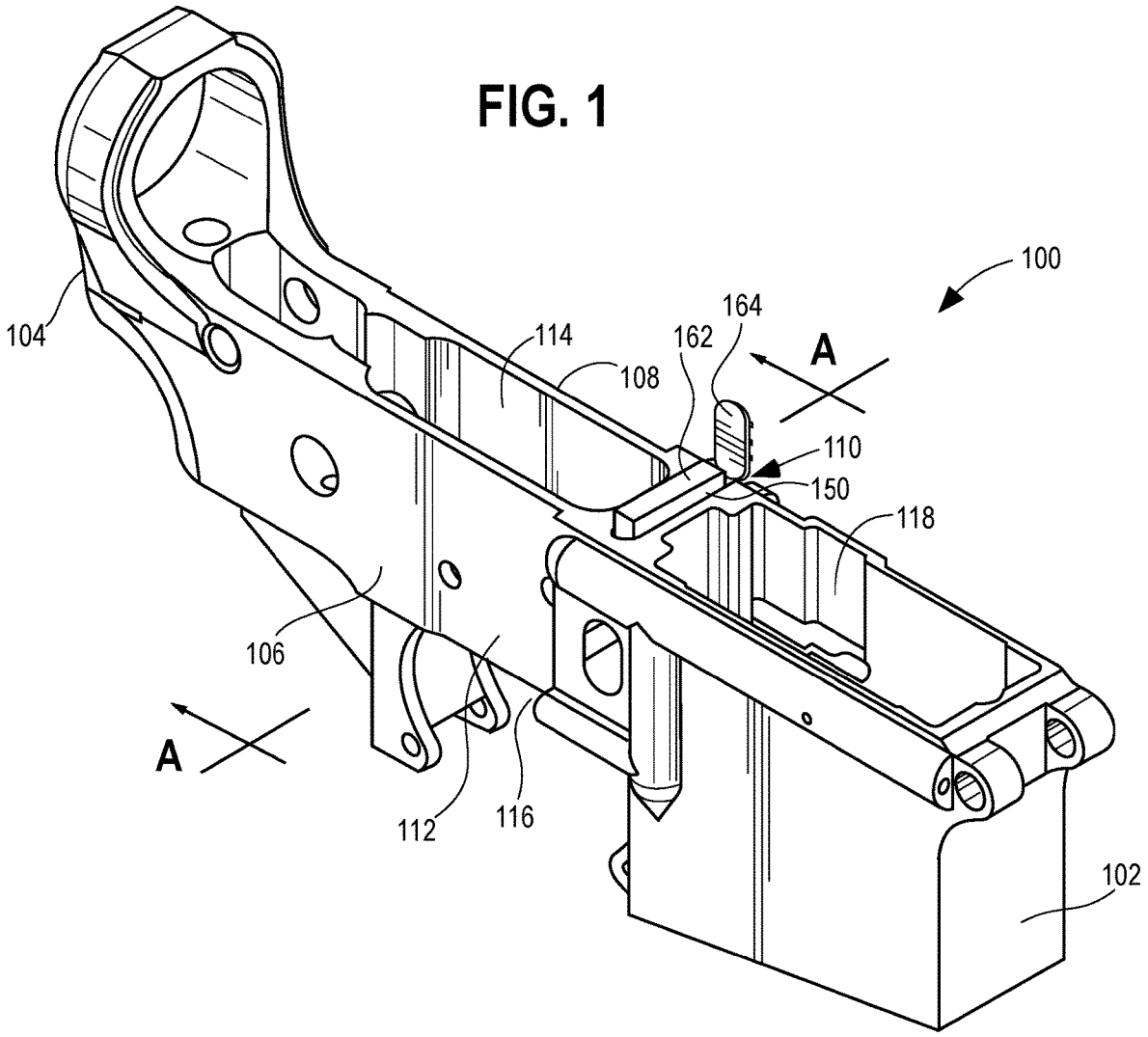
FIG. 1 is an isometric view of left, front, and top sides of a receiver for a firearm having a blocking mechanism installed therein.
Figure 1A:
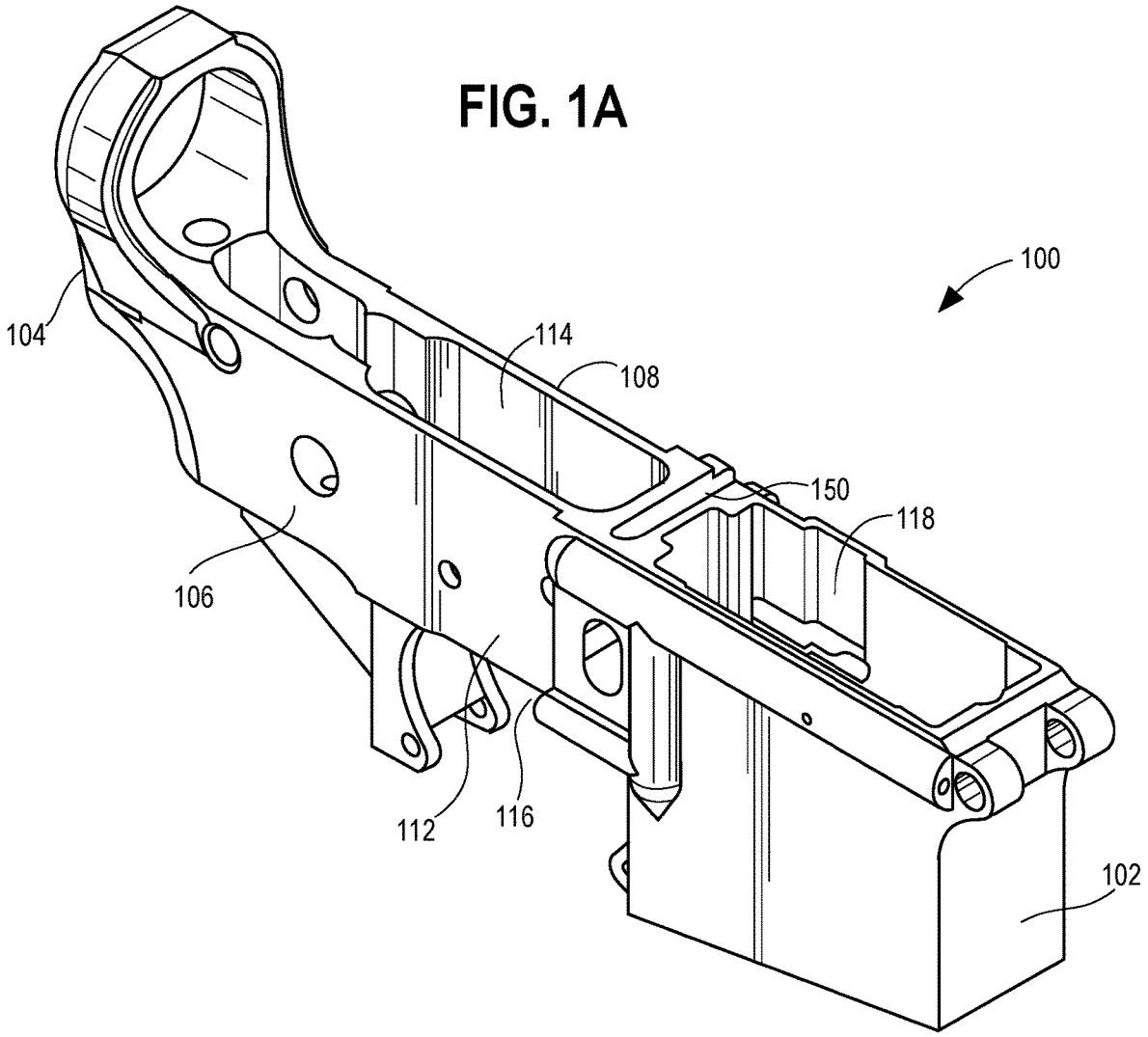
FIG. 1A is an isometric view of left, front, and top sides of the receiver of FIG. 1.
Figure 1B:
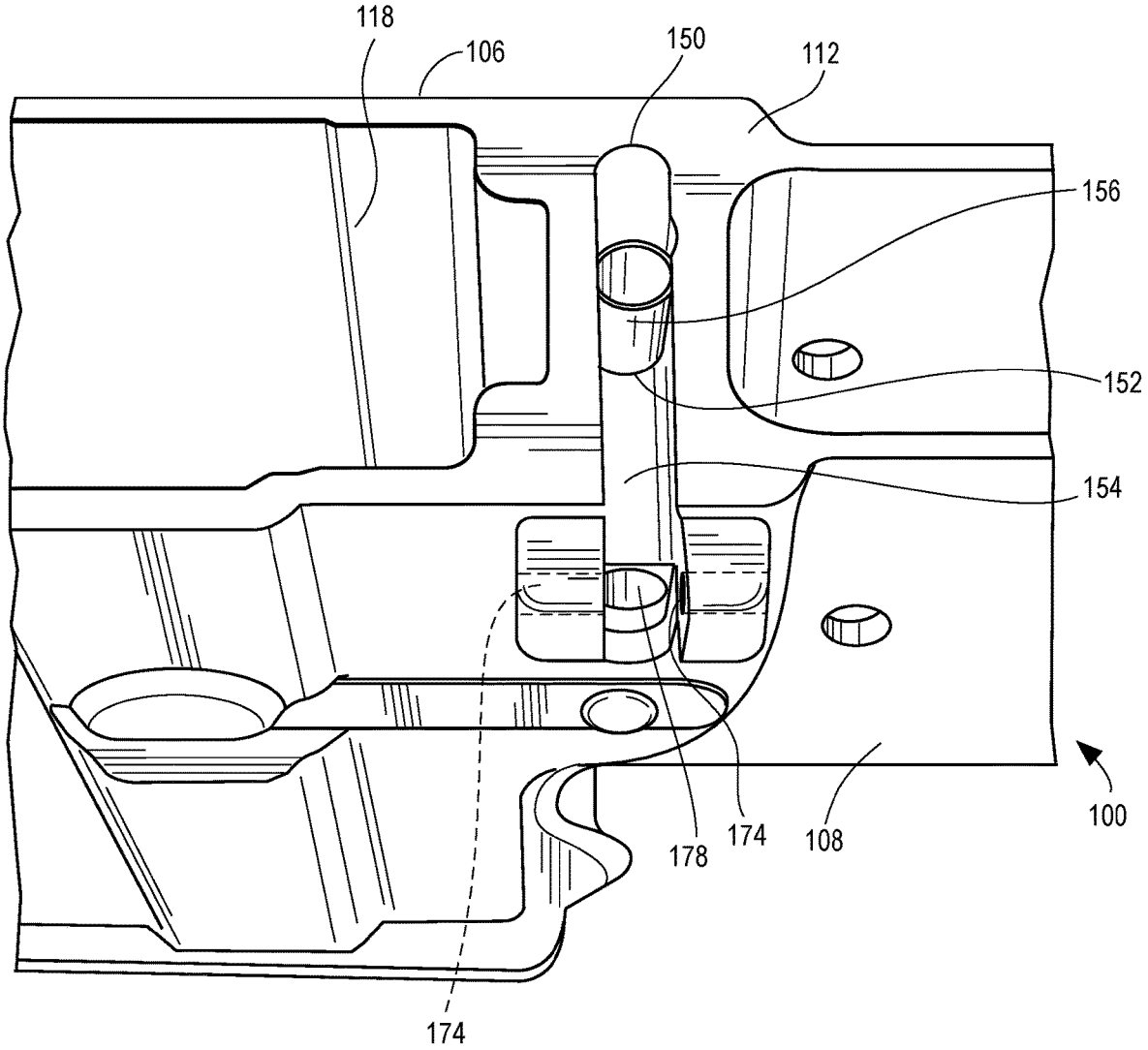
FIG. 1B is an isometric view of right and top sides of the receiver of FIG. 1 having a portion of the blocking mechanism installed therein.

Referring to FIGS. 1, 1A, and 1B, a receiver 100 for use with a non-semiautomatic firearm, has a front side 102, a rear side 104, a left side 106, and a right side 108. When the receiver 100 is used with other components of a firearm, the front side 102 of the receiver 100 is proximate a discharge portion of the firearm relative to the rear side 104 thereof. The receiver 100 may substitute prior art semiautomatic receivers that would be apparent to one who has ordinary skill in the art and includes a body 102, a portion 114 through which a trigger group may be inserted so that the trigger group extends into a cut out section 116 of the receiver 100, and a magazine well 110. However, the receiver 100 includes differences in, for example, milling and/or construction, as described below to prevent a firearm with which such receiver 100 is used to operate in semiautomatic fashion. Thus, the receiver 100 is not simply a reconfigured receiver typically used with semiautomatic firearms such as an AR 15/10 firearm. Rather the receiver 100 is new type of receiver adapted for use with components compatible with the AR 15/10 and other firearms.

Figure 2:
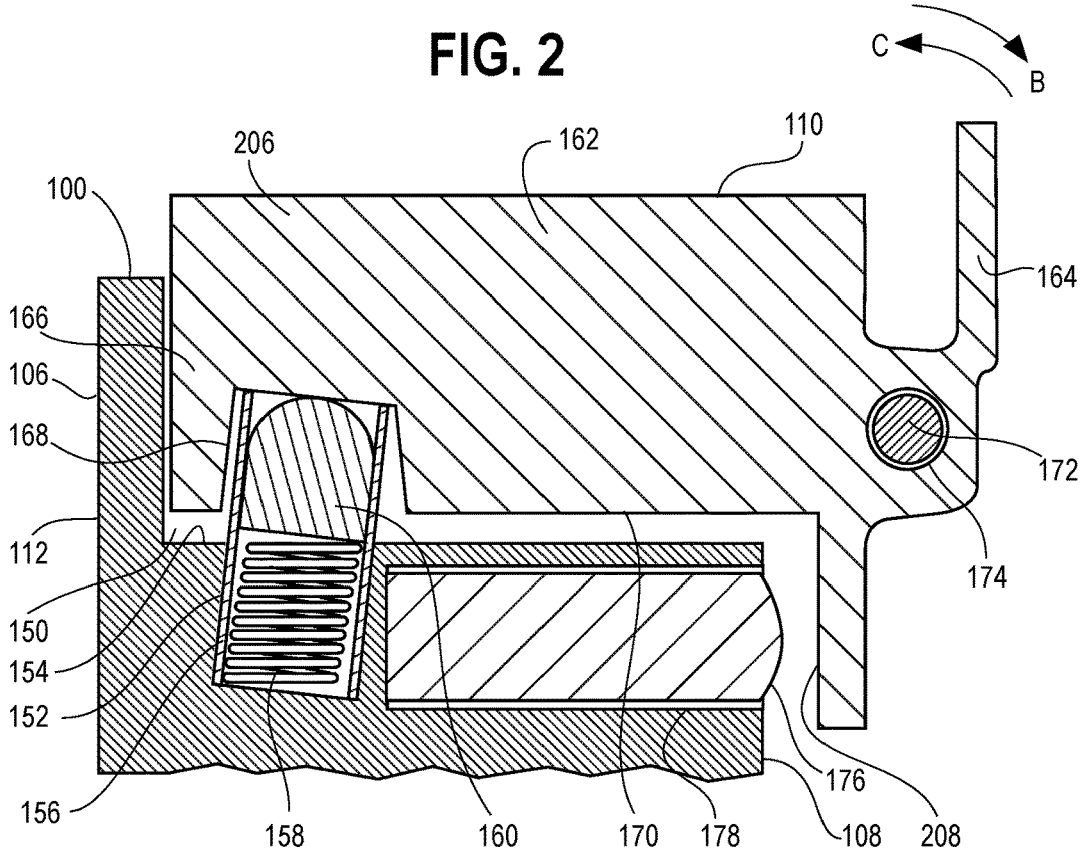
FIG. 2 is a cross-sectional view of the receiver of FIG. 1 taken generally along the lines A-A.
Figure 3:
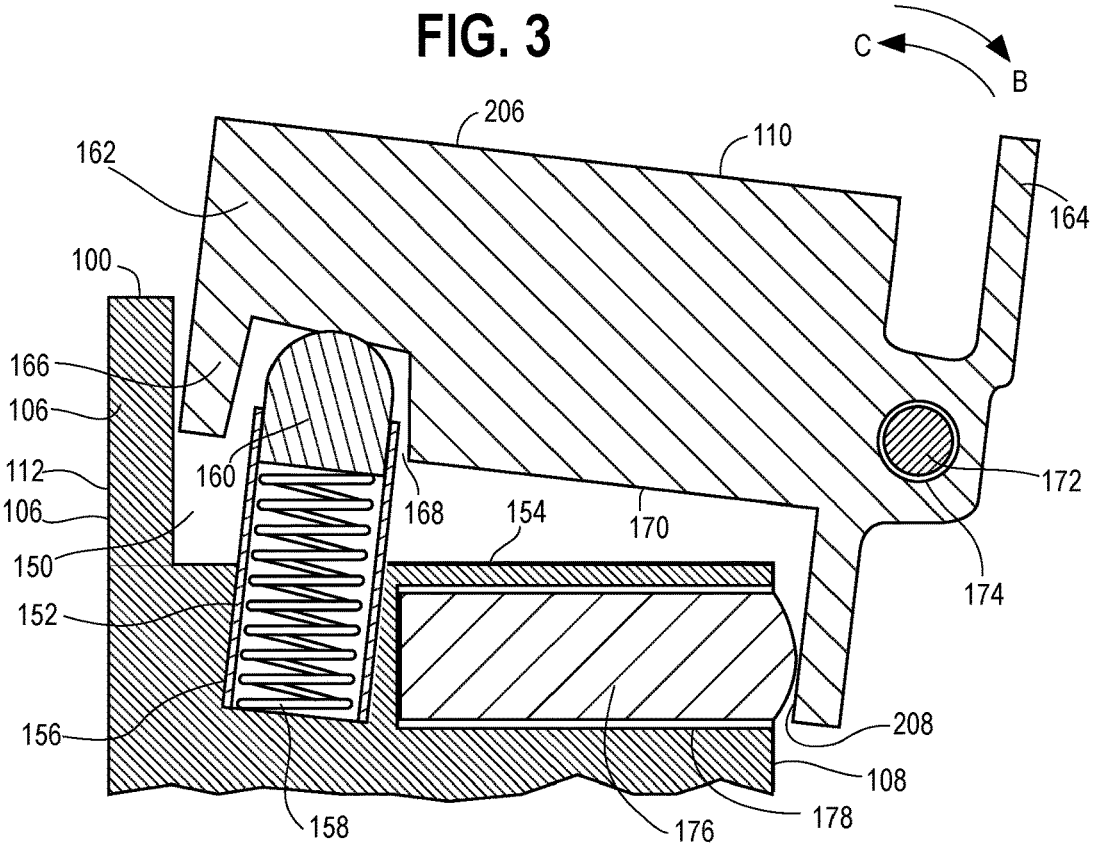
FIG. 3 is another cross-sectional view of the receiver of FIG. 1 taken generally along the lines A-A.

Referring also to FIGS. 2 and 3, the receiver 100 includes bolt block pocket 150 having an orifice 152 milled into a bottom wall 154 thereof. The blocking mechanism 110 is disposed in the pocket 150 and orifice 152. The blocking mechanism 110 includes a plunger control sleeve 156, a push spring 158, a plunger 160, a bolt block 162, and a release paddle 164. In some embodiments, the release paddle 164 is attached to the bolt block 162 and in other embodiments the release paddle 164 and bolt block 162 are milled from a single material and are integral with one another.

The plunger control sleeve 156 of the blocking mechanism 110 is inserted into the orifice 152 and extends upwardly from the bottom wall 154 of the receiver 100. Thereafter, the push spring 158 is inserted into the plunger control sleeve 156 and the plunger 160 is inserted into the plunger control sleeve 156 to rest atop the push spring 158.

In some embodiments, the plunger control sleeve 156 may be integral with the receiver 100 rather than a separate piece. In such embodiments, the orifice 152 is not necessary and the plunger control sleeve 156 is formed from the same material as the receiver 100. In still other embodiments, the plunger control sleeve 156 may be replaced by a shelf or ledge that rises upwardly from the bottom wall 154 and the spring 158 is disposed on such shelf. In some such embodiments, the shelf may include an indentation to facilitate positioning and/or hold the spring 158 in place.

The bolt block 162 is disposed into the receiver 100 such that at least a portion 166 of the bolt block 162 is disposed in the pocket 150 such that at least a portion of the plunger 160 is disposed in a notch 168 formed in a bottom wall 170 of the bolt block 162.

The bolt block 162 is pivotably secured to the receiver 100 by a pivot pin 172 disposed in receiving orifices 174 of the receiver 100 such that the bolt block 162 is movable between a downward position (FIG. 2) and an upward position (FIG. 3). In addition, the receiver 100 includes a spacer 176 disposed in a buffer hole 178 thereof. It should be apparent that conventional receivers include a similar hole 178 to accommodate, for example, a bolt catch spring of such conventional receivers.

Figure 4:
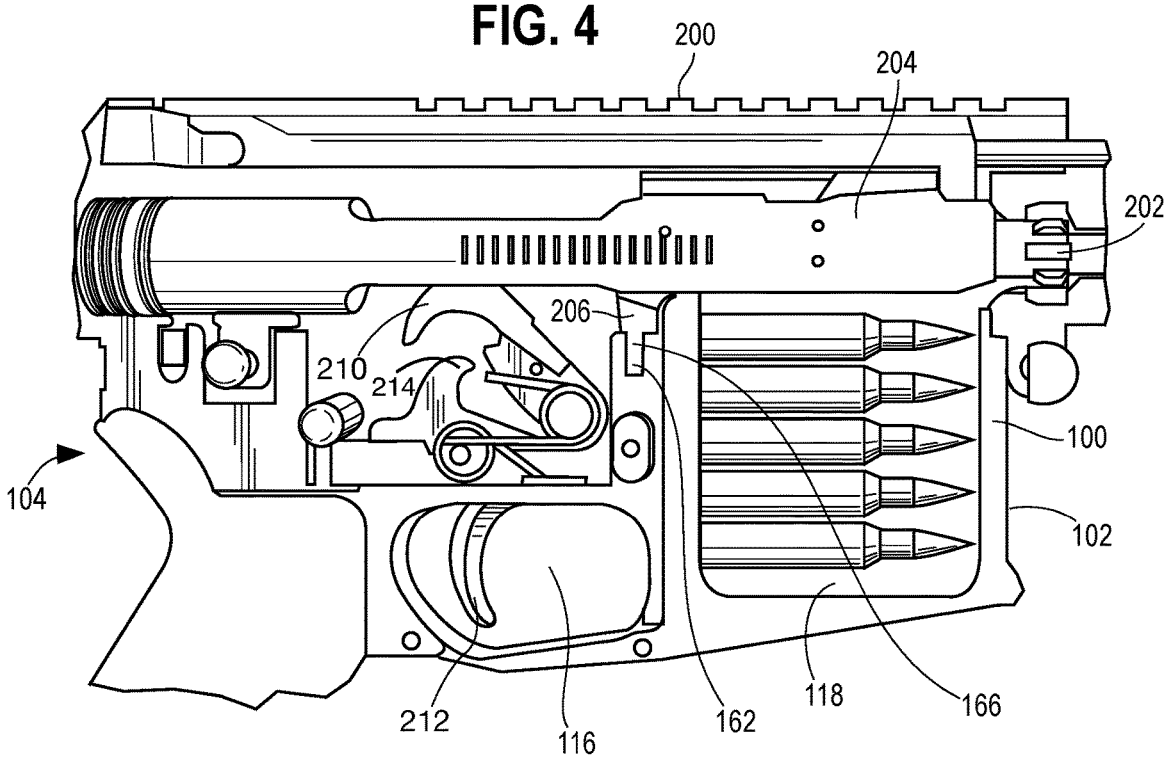
FIG. 4 is isometric view of portions of a firearm and the receiver of FIG. 1 having certain portions omitted for clarity.
Figure 5:
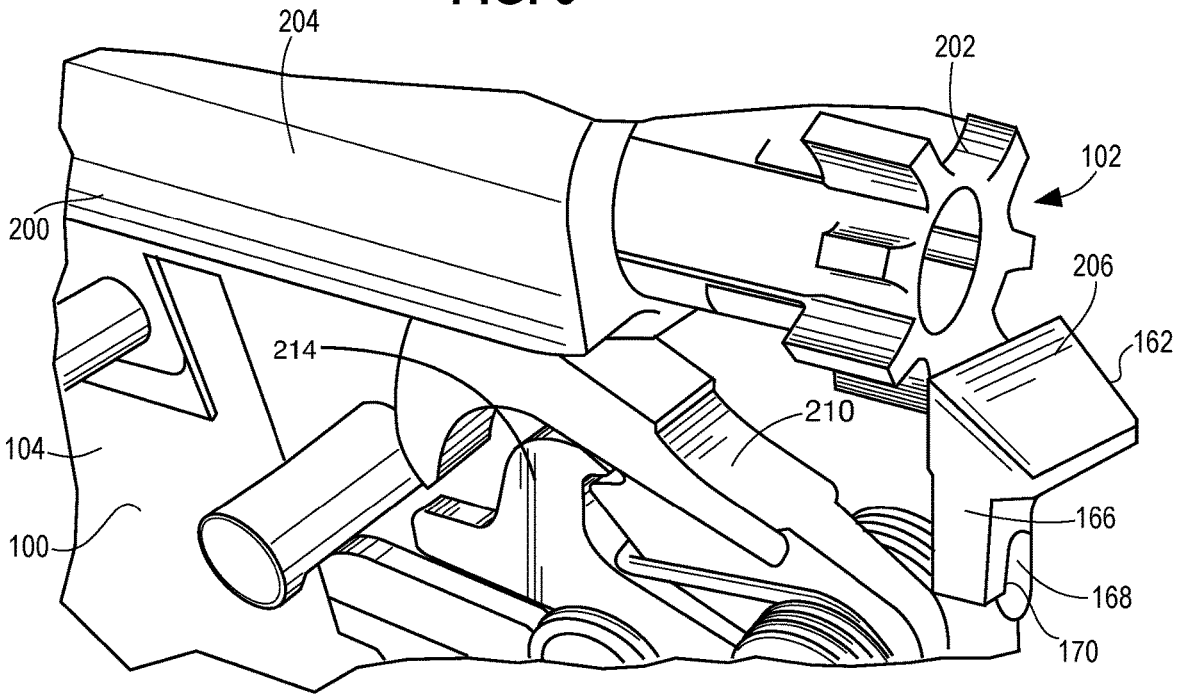
FIG. 5 is planar view of portion of a firearm and the receiver of FIG. 1 having certain portion omitted for clarity.

FIG. 4 shows a bolt 202 and a bolt carrier 204 of a firearm 200 that is chambered and ready to discharge a round and FIG. 5 shows the bolt 202 of the firearm 200 after the round has been discharged and blocked by the blocking mechanism 110 (FIG. 1). Referring to FIGS. 1-5, when the firearm 200 is in battery (see FIG. 4) with a round chambered and ready to fire, the bolt 202 of the firearm 200 extends past the bolt block 162 toward the front 102 of the receiver 100. When in this position, the bolt carrier 204 to which the bolt 202 is coupled is disposed such that that the bolt block 162 is urged via the plunger 160 against the push spring 158 and held in the downward position (see FIG. 2) by the bolt carrier 204.

As would be apparent to one who has ordinary skill in the art, after a round is fired, a portion of the energy causes the bolt 202 (and the bolt carrier 204) of the firearm 200 to unlock, eject, and extract a casing of the fired round. Thereafter, the bolt 202 and the bolt carrier 204 retract toward the rear 104 of the receiver 100 until the bolt 202 is between the rear 104 of the receiver 100 and a blocking portion 206 of the bolt block 162. When the bolt 202 is rearward of the bolt block 162, upward spring force exerted on the push plunger 160 by the push spring 158 urges the bolt block 162 to pivot about the pivot pin 172 in a direction shown by arrow B and into the upward position (see FIG. 3). The bolt block 162 pivots in this direction until a wall 208 of the bolt block 162 engages the spacer 176. When in the upward position, the blocking portion 206 of the bolt block 162 blocks the bolt 202 and thereby prevents the bolt 202 (and thus the bolt carrier 204) from moving forward (i.e., toward the front 102 of the receiver 100). Such blocking prevents chambering of another round and resetting a trigger 212 for firing of a subsequent round. In particular, while the bolt carrier 204 is held in the retracted position by the bolt block 162 (as shown in FIG. 5), the bolt carrier 204 blocks the hammer 210 from disengaging from a disconnector 214 and moving forward to engage with the trigger 212, and thus prevents resetting the trigger 212 to enable firing of a subsequent round.

The bolt block 162 remains in the blocking (i.e., upward) position until force is applied to the paddle 164 coupled the bolt block 162 to cause the bolt catch 162 to pivot about the pivot pin 172 in the direction shown by the arrow C. Pivoting the bolt block 162 in this manner moves the bolt block 162 into the downward position (see FIG. 2). When the bolt block 162 is moved sufficiently in the downward position so that the bolt block 162 is below the bolt 202, the bolt block 162 stops blocking the bolt 202 and the bolt 202 and the bolt carrier 204 are allowed to move forward toward the front 102 of the receiver 100. Such forward movement of the bolt 202 loads another round (if there is a round in the magazine or manually loaded in the round chamber) and the firearm 200 is ready to fire another round (i.e., the firearm is in battery).

As would be apparent to one who has ordinary skill in the art, a lever (not shown) may be coupled to the bolt block 162 and, when the bolt block 162 is in the upward position, moving the lever urges the bolt block 162 into the downward position. The lever and/or paddle 164 may be disposed on the left side 106, the right side 108, or both the left side 106 and the right side 108 of the receiver body. Having the lever and/paddle 164 on both the left side 106 and the right side 108 facilitates left handed or right handed, respectively, use of the lever and or paddle 164 to return the bolt block 162 into the downward position. Further, in some embodiments, such lever(s) may be coupled to the paddle 162.

It should be apparent to one who has ordinary skill in the art that functions of the push spring 158 and/or the plunger 160 may be provided by other components such as, for example, a V spring or another component that operates to lift the bolt block 162 into the upward position after a shot is fired to block forward movement of the bolt 202 and bolt carrier 204. Further, as would be apparent to one of ordinary skill in the art, orifices in receiver may be formed to accommodate the components described herein or to accommodate other components, such as V springs, levers, and the like noted above, that provide a similar function.

INDUSTRIAL APPLICABILITY

With respect to the above description, the optimum dimensional relationships for the parts of the invention, to include variations in size, materials, shape, form, function and manner of operation, assembly and use, are deemed readily apparent and obvious to one of ordinary skill in the art, and all equivalent relationships to those illustrated in the drawings and described in the specification are intended to be encompassed by the present invention.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure.

What is claimed is:

1. A receiver, for a firearm, comprising:

a bolt block pocket having an orifice formed in a bottom wall thereof; and a blocking mechanism moveable between an upward and a downward position, wherein the blocking mechanism comprises a spring disposed in the orifice, wherein the blocking mechanism is in the downward position when the firearm is in battery and automatically moves to the upward position after a round is fired, and wherein the blocking mechanism prevents automatic reloading of the firearm when in the upward position.

2. The receiver of claim 1, wherein the firearm comprises a bolt carrier, a hammer, and a trigger, wherein when the blocking mechanism is in the upward position, the blocking mechanism holds the bolt carrier in a retracted position such that the bolt carrier blocks movement of the hammer to engage with the trigger and thereby prevents resetting of the trigger.

3. The receiver of claim 2, wherein the blocking mechanism includes a plunger disposed atop the spring and a bolt block, a bottom wall of the bolt block includes a notch, and at least a portion of the plunger is disposed in the notch.

4. The receiver of claim 3, wherein the blocking mechanism includes a sleeve disposed in the orifice and the spring is disposed in the sleeve.

5. The receiver of claim 1, wherein the blocking mechanism is coupled to the receiver mechanism by a pivot pin and a portion of the blocking mechanism pivots about the pivot pin when the blocking mechanism is moved between the downward position to the upward position.

6. The receiver of claim 1, in combination with other components of a firearm, wherein the components include a bolt and a bolt carrier, wherein the bolt carrier holds the blocking mechanism in the downward position when the firearm is in battery.

7. The receiver of claim 6, wherein the blocking mechanism engages the bolt to block forward movement of the bolt.

8. The receiver of claim 1, wherein the blocking mechanism includes a release paddle, wherein the release paddle allows manual movement of the blocking mechanism from the upward position to the downward position.

9. The receiver of claim 1, further comprising a spacer extending outwardly from a side of the receiver, wherein the spacer stops upward movement of the blocking mechanism.

10. A method for preventing automatic reloading of a firearm comprising:

disposing a blocking mechanism moveable between an upward and a downward position in a receiver of the firearm;

disposing a spring of the blocking mechanism in an orifice formed in a bottom wall of a bolt pocket of the receiver;

holding the blocking mechanism in the downward position when the firearm is in battery; and automatically moving the blocking mechanism to the upward position after a round is fired, wherein the blocking mechanism prevents automatic reloading of the firearm when in the upward position.

11. The method of claim 10, further including preventing resetting a trigger of the firearm when the blocking mechanism is in the upward position.

12. The method of claim 11, wherein disposing the blocking mechanism further includes disposing a plunger atop the spring and in a notch formed in a bottom wall of a bolt block of the blocking mechanism.

13. The method of claim 12, wherein disposing the spring in the orifice includes disposing a sleeve in the orifice and disposing the spring in the orifice.

14. The method of claim 10, wherein moving the blocking mechanism between the downward position and the upward position includes pivoting a portion of the blocking mechanism about a pivot pin that couples the portion of the blocking mechanism and the receiver.

15. The method of claim 10, further including holding the blocking mechanism in the downward position by a bolt carrier of the firearm.

16. The method of claim 15, further including blocking forward movement of the with the blocking mechanism when the blocking mechanism is in the upward position.

17. The method of claim 10, further including manually moving the blocking mechanism from the upward position to the downward position.

18. The method of claim 10 further including stopping upward movement of the blocking mechanism.

* * * * *